US007475659B2

(12) United States Patent
Arnell

(10) Patent No.: US 7,475,659 B2
(45) Date of Patent: Jan. 13, 2009

(54) DEVICE COMBUSTION ENGINE

(75) Inventor: Jan Arnell, Onsala (SE)

(73) Assignee: Volvo Lastvaguar AB, Gothenburg (SE)

( * ) Notice: Subject to any disclaimer, the term of this patent is extended or adjusted under 35 U.S.C. 154(b) by 56 days.

(21) Appl. No.: 11/721,639

(22) PCT Filed: Feb. 11, 2005

(86) PCT No.: PCT/SE2005/000189

§ 371 (c)(1),
(2), (4) Date: Jun. 13, 2007

(87) PCT Pub. No.: WO2006/085802

PCT Pub. Date: Aug. 17, 2006

(65) Prior Publication Data

US 2008/0184951 A1 Aug. 7, 2008

(51) Int. Cl.
*F01L 1/34* (2006.01)

(52) U.S. Cl. ..... 123/90.16; 123/90.39; 123/90.44; 123/90.6; 123/90.65; 74/559

(58) Field of Classification Search ..... 123/90.16, 123/90.2, 90.22, 90.39, 90.44, 90.6, 90.65, 123/90.66, 90.67; 74/559, 567, 569
See application file for complete search history.

(56) References Cited

U.S. PATENT DOCUMENTS 6,186,101 B1 * 2/2001 Kreuter ..... 123/90.15
6,439,195 B1 8/2002 Warner

FOREIGN PATENT DOCUMENTS

| | | |
|---|---|---|
| EP | 1219791 A2 | 7/2002 |
| SE | 523622 C2 | 5/2004 |
| WO | 03031778 A1 | 4/2003 |

OTHER PUBLICATIONS

International Search Report for corresponding International Application PCT/SE2005/000189.

* cited by examiner

*Primary Examiner*—Ching Chang
(74) *Attorney, Agent, or Firm*—WRB-IP LLP

(57) ABSTRACT

A device for controlling valve movements in an internal combustion engine includes a rotating camshaft having a cam curve, the camshaft being designed, via a rocker arm, to interact with a valve mechanism for operating the inlet or exhaust valve by a valve spring. The valve mechanism includes timing gear which allows the return movement of the valve mechanism to be controlled during the closing phase of the inlet valve or exhaust valve, independently of the cam curve. A resilient element is arranged between the rocker arm and a fixed point in such a way that the rocker arm continuously follows the cam curve as the camshaft rotates. The force of the valve spring is adjusted to the moving mass of the valve mechanism and to forces counteracting the valve closure. The force exerted by the resilient element are adjusted to the mass of the rocker arm for the purpose of minimizing the energy losses of the valve mechanism. Respective central contact points between the rocker arm shaft and the rocker arm during the period when the rocker arm and the valve mechanism are separated or not separated are displaced in relation to one another in order to ensure lubrication of the rocker arm shaft.

15 Claims, 3 Drawing Sheets

DEVICE COMBUSTION ENGINE

BACKGROUND AND SUMMARY

The present invention relates to a device for controlling valve movements in an internal combustion engine which has at least one inlet valve and at least one exhaust valve for controlling the connection between a combustion chamber in the cylinder and an intake system or an exhaust system, a rotating camshaft having a cam curve, comprising a rising ramp and a falling ramp, being designed to interact with a valve mechanism for operating the inlet or exhaust valve by means of a valve spring, the valve mechanism comprising timing gear which allows the return movement of the valve mechanism to be controlled during the closing phase of the inlet or exhaust valve, independently of the falling ramp of the cam curve.

In internal combustion engines for vehicles it is sometimes desirable to be able to switch between different operating modes. For example, it is possible to switch between a conventional symmetrical cycle and an asymmetrical cycle, such as a so-called Miller cycle, by varying the inlet valve closing point during the engine induction stroke. The advantage of being able to switch between these different operating modes lies, for example, in the fact that the effective compression ratio of the engine can be varied in order to optimize the efficiency and to minimize the exhaust emissions. To this end, variable valve timing is therefore necessary. An example of such a known arrangement is demonstrated by SE523622. The device according to SE523622 allows the return movement of the valve mechanism to be controlled during the closing phase of the inlet or exhaust valve, independently of the falling ramp of the cam curve. By means of a hydraulically adjustable device which counteracts the closing force of the valve spring, the timing gear serves to retard the valve closure for an adjustable time interval. When running in the Miller cycle mode the device according to SE523622 functions as a conventional mechanical valve system, that is to say the greater part of the energy stored in the valve spring during opening of the valve is recovered when the valve returns to its closed position, in that the force of the valve spring imparts a drive torque to the camshaft during closure of the valve. When the arrangement according to SE523622 is not being run in the Miller cycle mode, the valve closure is retarded for an adjustable time interval by the closing force of the valve spring counteracting the hydraulic device. This means that the energy from the vehicle engine, which via the camshaft and the rocker arm is expended in tensioning the valve springs (during opening of the valve), is in valve closure dissipated into the hydraulic device, when the latter is connected for the purpose of retarding the valve closure.

U.S. Pat. No. 6,439,195 discloses the arrangement of a spring 82 between a fixed point on the engine and the rocker arm, with the aim of ensuring continuous contact between the rocker arm roller and its opposing camshaft cam. The force of the spring 82 and the opposing force exerted by the camshaft produce a vertically upward force on the rocker arm (see FIG. 1 in U.S. Pat. No. 6,439,195). This means that the rocker arm shaft 4 and the rocker arm 2 are in constant contact over a limited surface in principle situated at the very bottom of the circumference of the rocker arm shaft. Since the rocker arm, during a rotational cycle, turns only a few degrees forwards and back, it is more difficult for a lubricating film to build up on said contact surface (compared to a shaft which turns many revolutions). The lubrication problem with this design construction can occur over the entire cam curve, that is to say both when the rocker arm roller follows the base circle of the camshaft and also when the rocker arm roller follows the shape of the cam. The limited contact surface may further give rise to a concentrated wear, as a result of which the constituent parts may have a more limited service life. The location of the spring 82 in the arrangement according to U.S. Pat. No. 6,439,195 also makes both assembly and maintenance work on said spring more difficult.

It is desirable in an arrangement according to SE523622 therefore to maximize the recovery of the energy which is needed to tension the valve spring and to ensure lubrication of the rocker arm shaft/the rocker arm bearing and to prolong the service life of the constituent parts. It is desirable to facilitate the assembly of and any maintenance work on the valve arrangement.

The device according to an aspect of the invention comprises a device for controlling valve movements in an internal combustion engine which has at least one inlet valve and at least one exhaust valve for controlling the connection between a combustion chamber in the cylinder and an intake system or an exhaust system, a rotating camshaft having a cam curve, comprising a rising ramp and a falling ramp, being designed, via a rocker arm, to interact with a valve mechanism for operating the inlet or exhaust valve by means of a valve spring. The valve mechanism comprises timing gear, which allows the return movement of the valve mechanism to be controlled during the closing phase of the inlet or exhaust valve, independently of the falling ramp of the cam curve, and in which timing gear is designed so that the closure of the valve can be retarded for an adjustable time interval by means of a hydraulically adjustable force counteracting the closing force of the valve spring. The rocker arm and the valve mechanism are separated during the period of retardation, so that there is no interchange of force between them. An aspect of the invention is characterized in that a resilient element is arranged between the rocker arm and a fixed point on the internal combustion engine in such a way that the rocker arm continuously follows the cam curve as the camshaft rotates, and that the valve spring force is adjusted to the moving mass of the valve mechanism and to forces counteracting the valve closure, and that the force exerted by the resilient element is adjusted to the mass of the rocker arm, for the purpose of minimizing the energy losses of the valve mechanism.

One advantage obtained with the device according to an aspect of the invention is that the energy losses of the valve mechanism are minimized. It furthermore ensures that the contact between the rocker arm roller/sliding contact and the camshaft cam are maintained. Further advantages obtained are a more favorable pressure increase and reduced pressure fluctuation in the system hydraulics.

In one advantageous embodiment of the device according to an aspect of the invention the valve spring force is minimized and the spring force exerted by the resilient element is maximized. The advantage of this is that the energy losses of the valve mechanism can be further minimized.

In a further advantageous embodiment of the invention the sum of the spring forces is greater than what is required to counteract the force exerted by the sum of the moving mass of said valve mechanisms, the forces counteracting the valve closure and the mass of said rocker arm. This contributes further to a reduced energy loss.

Contact surfaces are formed between the rocker arm shaft and the rocker arm in order to maintain a balance of forces in the respective state of the valve arrangement. A first and a second contact surface respectively are formed between said rocker arm and rocker arm shaft during the period when the rocker arm and the valve mechanism are separated from one another and during the period when the rocker arm and the valve mechanism are not separated and exert a force on one another. In a further embodiment of the device according to the invention said first and second contact surfaces are displaced from one another. This serves to ensure that all slide surfaces of the rocker arm shaft and the rocker arm which come into contact with one another receive lubrication. The fact that the contact surfaces can be changed means that a better distribution of force is achieved over the slide surfaces. Any wear is more evenly distributed, thereby increasing the service life of the constituent parts.

In yet another embodiment of the device according to an aspect of the invention a force exerted by the resilient element and an opposing force in a contact surface between the rocker arm roller and the camshaft are directed basically straight against one another, so that the force acting on the rocker arm is minimized. In this way the contact surfaces for the two states can be subjected to the maximal displacement from one another (the central point for the contact surfaces is displaced by 180 degrees), which helps to maximize the distribution of force and to improve the lubrication of the rocker arm shaft/the rocker arm bearing.

In order to facilitate assembly and maintenance, in a further embodiment of the device according to an aspect of the invention said resilient element is arranged on top of the rocker arm.

BRIEF DESCRIPTION OF THE DRAWINGS

The invention will be described in more detail below with reference to an exemplary embodiment, which is shown in the drawings attached, in which.

DETAILED DESCRIPTION

Figure 1:
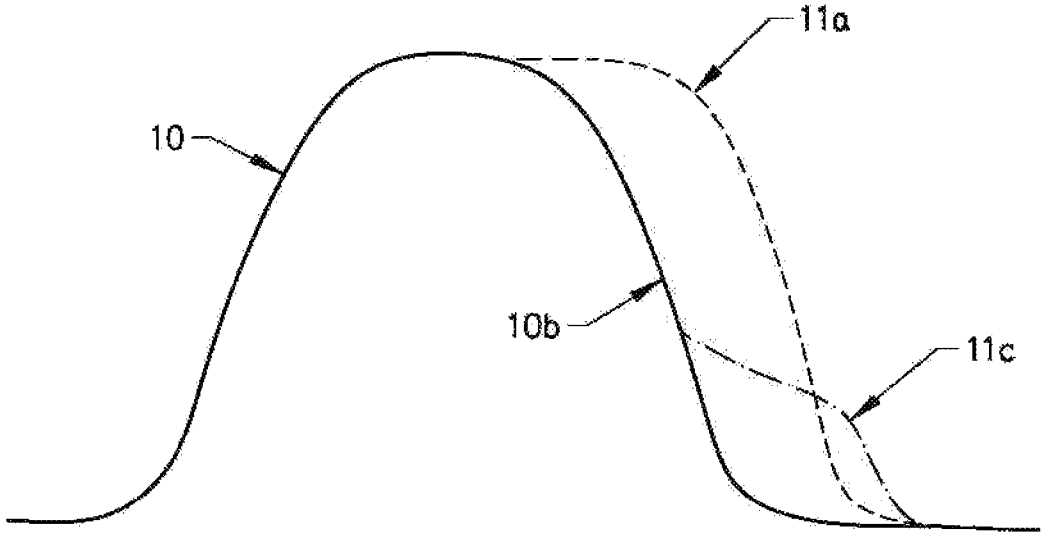
FIG. 1 is a graph showing the movement of the inlet valve in a valve mechanism according to the invention.

The graph shown in FIG. 1 illustrates how an inlet valve functions in an internal combustion engine according to the present invention. The engine is designed so that it can switch between a first operating mode, which corresponds to the solid line 10 in FIG. 1, and other operating modes which correspond to the lines 11 a and lie in FIG. 1. Here the inlet valve according to line 10 follows the rising ramp and falling ramp on a camshaft cam curve, which according to one exemplary embodiment is designed to drive the internal combustion engine in a Miller cycle with maximum advancement of the closure of the inlet valve. The line 10*b* represents the fixed cam curve. According to the state of the art a fixed cam curve can describe either a normal, an advanced or a retarded valve closure.

The method of operation according to the cam curve 10 and 10*b* shown means that the inlet valve closes so early during the inlet phase that the volume of gas enclosed in the cylinder can expand before the piston reaches its bottom dead center following the inlet phase. The temperature of the volume of gas is thereby reduced, so that subsequent compression and ignition can occur at a reduced temperature level, which makes it possible to reduce the $NO_x$ content of the engine exhaust gases.

In a second operating mode the inlet valve according to the line 11*a* follows the rising ramp of the cam curve but then leaves the falling ramp, so that the inlet valve closes at a later point (crank angle). The line 1*a* here represents a prolonged cycle (cf. 10*b*). This cycle may be advantageous when the engine is operating under transient conditions and in certain parts of the engine operating range.

In a third operating mode the inlet valve according to line lie follows the rising ramp of the cam curve and the first part of the falling ramp 10*b* but then leaves the falling ramp, so that the inlet valve closes at a point which in the example shown occurs somewhat later than normal closure.

Figure 2:
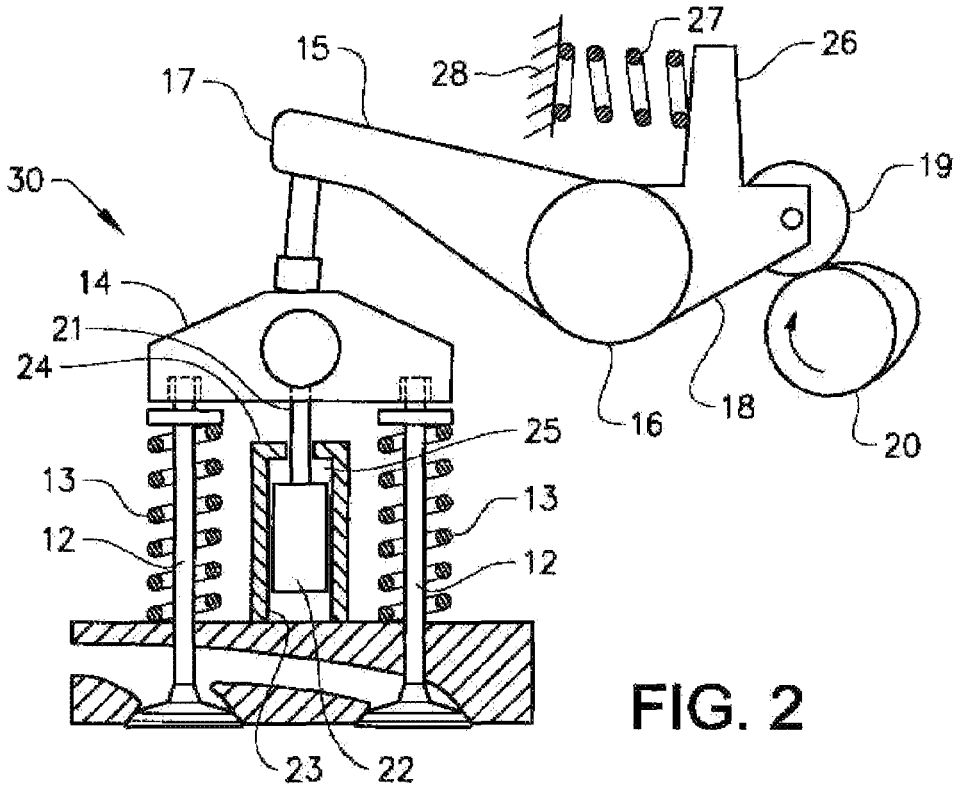
FIGS. 2 to 4 show a schematic representation of a valve mechanism in three of a number of possible states according to a first exemplary embodiment of the invention.

The valve mechanism 30 shown in schematic form in FIG. 2 is located in a cylinder head and comprises double inlet valves 12, a common yoke 14 and a hydraulic piston 22 with piston rod 21. The valve mechanism 30, by way of the yoke, is actuated in a known manner by a rocker arm 15, which is pivotally supported on a rocker arm shaft 16. On one side of the shaft the rocker arm 15 has a valve pressure arm 17 and on the other side a cam follower 18, which is provided with a rocker arm roller 19, which interacts with an overhead camshaft 20. Alternatively a camshaft located at a lower level in the engine may interact with the rocker arm via a valve tappet and a push rod (not shown). In the exemplary embodiment shown a projecting part 26, against which a resilient element 27, in the exemplary embodiment shown a coil spring, acts with its one end, is arranged on the cam follower 18. The other end of the resilient element 27 acts against a fixed point 28, preferably on the internal combustion engine of the vehicle. The rocker arm 15 is acted upon in a manner known in the art by the resilient element 27 in order to maintain the contact between the rocker arm roller 19 and the camshaft 20.

Figure 3:
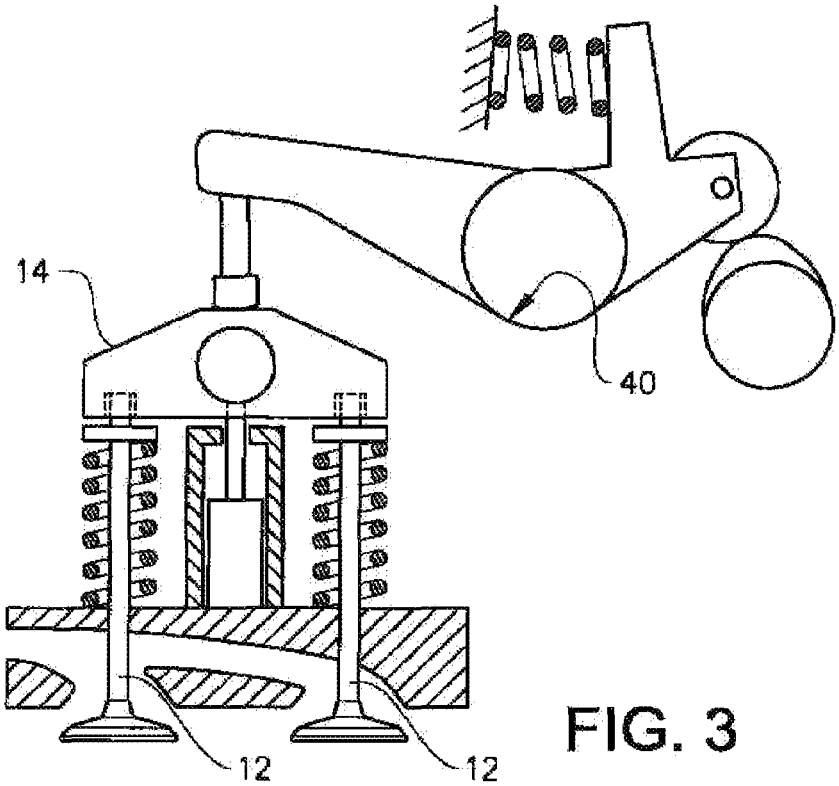
Figure 4:
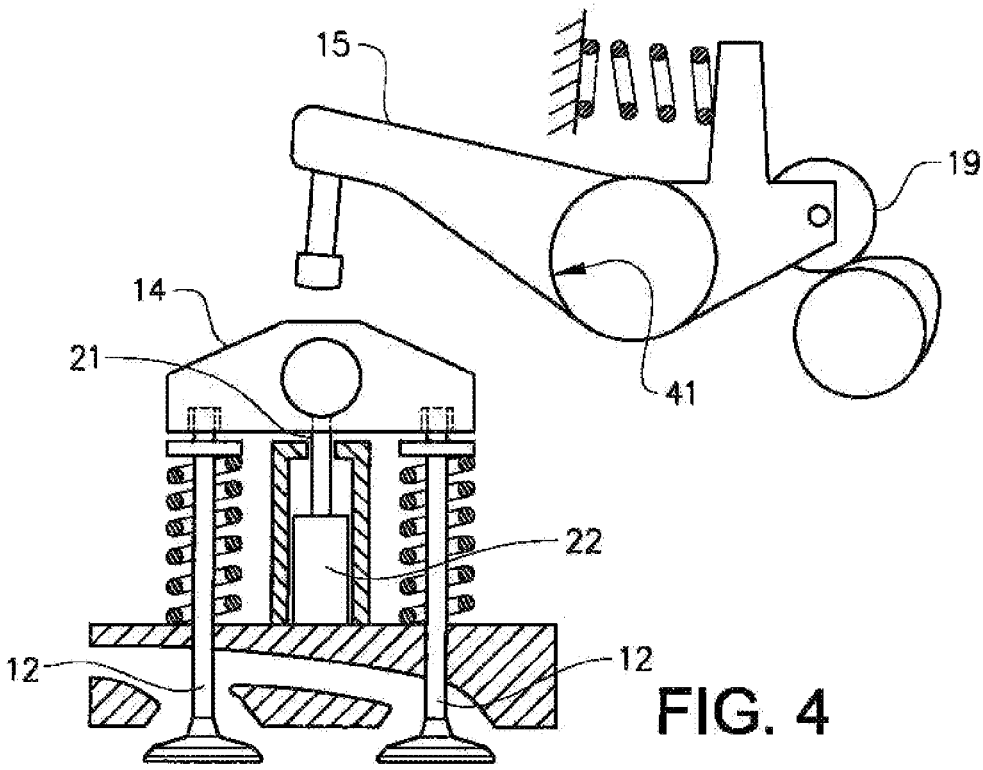
Figure 5:
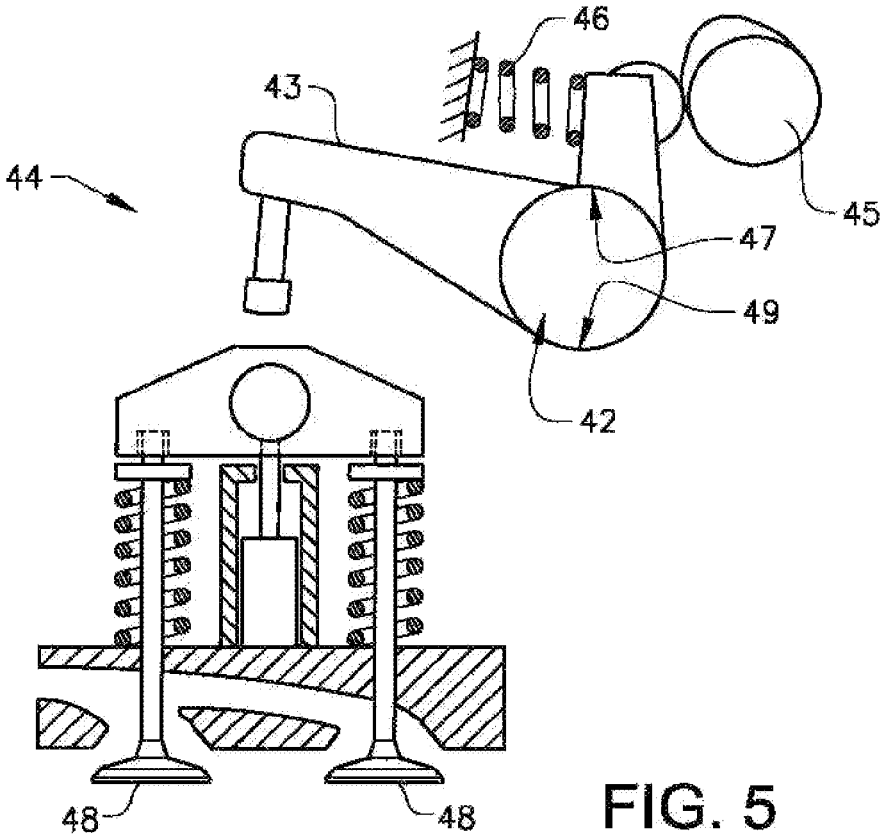
FIG. 5 shows a schematic representation of a further valve mechanism in one of a number of possible states according to a second exemplary embodiment of the invention.

In the embodiment shown according to FIG. 2 and the following embodiments according to FIGS. 3 to 5 the direction of rotation of the camshaft 20 is clockwise (see the arrow in FIG. 2).

The yoke 14 is mounted on a piston rod 21 by way of an articulated joint (for example a knuckle joint, ball joint or rubber joint). The piston rod 21 is supported so that it is vertically displaceable by a piston 22 in a cylinder 23. The end 24 of the cylinder is provided with sealing against the piston rod 21, so that a fluid-tight space 25 is formed between the piston and the end. The space 25 can communicate via a hydraulic line (not shown) and a control valve (not shown) with a pressure pump (not shown).

The valve mechanism therefore normally follows the lifting curve 10, 10*b*, said control valve being situated in its inactive control position. In this position unpressurized hydraulic fluid can flow freely between the space 25 and a reservoir (not shown), whilst the yoke 14 moves down and up under the action of the rocker arm in one direction and the valve springs 13 in the opposite direction.

When the engine control unit registers that it is time to switch to another operating mode, said control valve is made to assume its active position, the next depression of the yoke 14 enabling said pump to fill the space 25 with hydraulic fluid from said reservoir. Once the downward movement is completed, that is to say when the valves 12 are fully open (see FIG. 3), and the yoke 14 commences its upward movement, the yoke is prevented for a suitable period of time from moving upwards, preferably by the action of a valve (not shown) in the hydraulic system. The upward movement of the yoke is initiated at a suitable point in time by the control valve being returned to its inactive position again. This allows the inlet valves 12 to be closed at a suitable crank angle. FIG. 4 shows a state in which the valve closure is retarded. The retardation may correspond, for example, to curve 11*a* or lie in FIG. 1. In FIG. 4 it can be seen that the yoke 14 and the rocker arm 15 are physically separated during the retardation of the valve closure. Thus no force is transmitted between the yoke and the rocker arm during the retardation, and this state therefore implies two separated partial mass systems, one of which is represented by the moving parts (12, 14, 21, 22) of the valve mechanism 30 and the other by the rocker arm 15 (including the rocker arm roller 19).

According to the present invention the valve spring force is adjusted to the mass of said moving parts of the valve mechanism 30 and to forces counteracting the valve closure, such as the pressure in the inlet duct and the force exerted by the piston 22 when the hydraulic fluid is to be expelled from the space 25. According to the invention the force exerted by the resilient element 27 is furthermore adjusted to the mass of the rocker arm 15 (including the mass of the rocker arm roller 19). Designing each of said springs for the respective partial mass system produces a valve timing system of the type shown in FIGS. 2 to 4, in which the recovery of energy, which is stored in the tensioned springs and which is restored to the camshaft, can be maximized.

In one embodiment of the invention the sum of the spring forces is greater than what would have been needed in a system with the same total moving mass, but in which the valve mechanism 30 and the rocker arm are always physically coupled together (that is to say no state with partial mass systems occurs). Adjusting the respective spring force to the respective partial mass system reduces the loss of valve spring energy, which is not returned to the camshaft but is dissipated into the hydraulic parts of the system.

In an advantageous embodiment of the device according to the invention the valve springs can be made as "soft" as possible, but still strong enough to allow them to close the valves under all operating conditions. It is furthermore advantageous according to the invention to maximize the spring force exerted by the resilient element, but taking into account the speed range of the engine and without producing self-oscillation of the resilient element.

FIGS. 2, 3 and 4 show an embodiment of the invention in which the lubrication of the rocker arm shaft 16 has been improved, compared to the state of the art, by arranging the resilient element 27 in such a way that the main contact surface between the rocker arm 15 and the rocker arm shaft 16 can be displaced substantially, when the valve mechanism 30 switches from a state with retarded closure (according to FIG. 4) to a state in which the valve movement follows the cam curve (according to FIG. 3). In the state according to FIG. 3 the movement of the valves 12 follows the shape of the cam curve. The magnitude and the direction (not shown) of the valve spring forces and the magnitude and direction (not shown) of the forces exerted by the resilient element, and magnitude and direction (not shown) of the opposing force in the contact surface between the rocker arm roller 19 and the camshaft 20 results in a certain magnitude and direction of a force on a first contact surface 40 between the rocker arm shaft 16 and the rocker arm 15. In the figures arrows serve to indicate the central point of the respective contact surface. In the exemplary embodiment shown the central point 40 of the first contact surface ends up almost at the very bottom of the rocker arm shaft 16 in FIG. 3. In FIG. 4 the function for retarded closure of the valves 12 is activated and the movement of the valves therefore does not follow the shape of the cam curve. Here the force of the valve spring does not act upon the rocker arm 15. Another balance of forces is therefore obtained, which gives rise to a second central point 41 for the contact surface between the rocker arm shaft 16 and the rocker arm 15, which is substantially displaced compared to the first central point 40. In order to bring about a noticeable improvement in the lubrication function compared to the state of the art, a substantial displacement between the first central point 40 and the second central point 41 is required. The relationship between parameters such as the play between rocker arm shaft and rocker arm, the dimensions of the rocker arm/rocker arm shaft, the shape of the slide-bearing surface and the design of the lubrication device etc, have an effect on the magnitude of the displacement needed in order to achieve an improved lubrication function.

FIG. 5 shows a further embodiment of a valve mechanism 44 according to the invention in which said corresponding central points for the contact surfaces between a rocker arm shaft 42 and a rocker arm 43 are maximally displaced (displacement of approximately 180 degrees) when the valve mechanism 44 is situated in said corresponding state (according to FIGS. 3 and 4).

The valve device according to FIG. 5 basically corresponds to the device according to FIGS. 2, 3 and 4 save for the design of the rocker arm 43 and the location of the camshaft 45 and the resilient element 46.

In the embodiment shown in FIG. 5 the force exerted by the resilient element 46 and the opposing force in the contact surface between the rocker arm roller and the camshaft 45 are directed basically straight against one another so that the force exerted by the resilient element 46 acting on the rocker arm 43 is minimized. In the state shown in FIG. 5 the valve mechanism 44 is situated in a position in which the retarded valve closure function is activated. The valve spring force therefore does not act upon the rocker arm 43. In the state shown the rocker arm 43 is in principle acted upon solely by the gravitational force, which for a first contact surface gives a first central point 47 at the very top of the rocker arm shaft 42.

When the valve mechanism 44 is in a state in which the movement of the valves 48 follows the cam curve, the valve spring force will act upon the rocker arm 43, producing a second central point 49 for a second contact surface basically at the very bottom of the rocker arm shaft 42. This embodiment thereby affords a maximum displacement of said central points in the contact surfaces between the rocker arm shaft and the rocker arm for said states. Note that FIG. 5 has also been used in order to show the lower central point 49, despite the fact that the valve mechanism in FIG. 5 is not actually in a state in which the movement of the valves follows the cam curve, that is to say a state that is required in order to produce the position of the central point 49.

Arranging the resilient element 27 or 46, according to the respective embodiment, on the upper side of each of the said rocker arms 15, 43 affords a location of the resilient element which is advantageous from the assembly and maintenance point of view. In servicing and maintenance a resilient element can be accessed relatively easily simply by opening a valve cover (not shown), covering the valve arrangement. In contrast to the state of the art, therefore, there is no need to dismantle the actual rocker arm 15 or 43.

Alternative locations of the piston cylinder 21-25 are possible. See, for example, FIGS. 3 to 5 in SE523622. FIG. 5 in SE523622 shows a variant in which the piston cylinder is connected to the valve yoke by way of an angled arm.

The device according to the invention has been demonstrated above in its application to an intake valve. It is also possible to apply the device to an exhaust valve. For example, this may be used for internal exhaust gas recirculation, so-called internal EGR, a variation of the exhaust valve closing sequence being capable of influencing the quantity of internal EGR by varying the degree of overlap between the inlet and exhaust valves following the exhaust stroke.

The invention must not be regarded as being limited to the exemplary embodiments described above, a number of further variants and modifications being feasible without departing from the scope of the following patent claims. For example, a type of spring other than the helical coil spring shown may be selected for each valve spring and resilient element.

The invention claimed is:

1. A device for controlling valve movements in an internal combustion engine, the device comprising at least one inlet valve and at least one exhaust valve for controlling a connection between a combustion chamber in a cylinder and an intake system or an exhaust system, respectively, a rotating camshaft having a cam curve, the cam curve comprising a rising ramp and a falling ramp, the camshaft being adapted to interact, via a rocker arm, with a valve mechanism for operating the inlet or exhaust valve by means of a valve spring, the valve mechanism comprising a timing gear which allows a return movement of the valve mechanism to be controlled during a closing phase of the inlet valve or exhaust valve, independently of the falling ramp of the cam curve, and in which the timing gear is designed so that closure of the valve can be retarded for an adjustable time interval by means of a hydraulically adjustable force counteracting a closing force of the valve spring, and the rocker arm and the valve mechanism are separated during the period of retardation, so that there is no interchange of force between them, and a resilient element arranged between the rocker arm and a fixed point on the internal combustion engine in a way that the rocker arm continuously follows the cam curve as the camshaft rotates and the valve spring force is adjusted to a moving mass of the valve mechanism and to a force counteracting the valve closure, and the force exerted by the resilient element is adjusted to a mass of the rocker arm.

2. The device as claimed in claim 1, wherein the valve spring force is minimized and the spring force exerted by the resilient element is maximized.

3. The device as claimed in claim 2, wherein a sum of spring forces is greater than what is required to counteract a force exerted by a sum of a moving mass of the valve mechanism, the forces counteracting the valve closure and the mass of the rocker arm.

4. The device as claimed in claim 2, wherein the resilient element is arranged on top of the rocker arm.

5. The device as claimed in claim 2, wherein the timing gear permits switching from an active to an inactive state during the return movement of the valve from an open position.

6. The device as claimed in claim 2, wherein the timing gear comprises a hydraulic piston cylinder which is mechanically connected to the valve and can be operated by a hydraulic valve.

7. The device as claimed in claim 1, wherein a sum of spring forces is greater than what is required to counteract a force exerted by a sum of a moving mass of the valve mechanism, the forces counteracting the valve closure and the mass of the rocker arm.

8. The device as claimed in claim 7, wherein the resilient element is arranged on top of the rocker arm.

9. The device as claimed in claim 7, wherein the timing gear permits switching from an active to an inactive state during the return movement of the valve from an open position.

10. The device as claimed in claim 7, wherein the timing gear comprises a hydraulic piston cylinder which is mechanically connected to the valve and can be operated by a hydraulic valve.

11. The device as claimed in claim 1, wherein a first and a second central point respectively are formed in a contact surface between the rocker arm and rocker arm shaft during a period when the rocker arm and the valve mechanism are separated from one another and during the period when the rocker arm and the valve mechanism are not separated and exert a force on one another, wherein the first central point and second central point are substantially displaced from one another.

12. The device as claimed in claim 11, wherein a force exerted by the resilient element and an opposing force in a contact surface between the rocker arm and the camshaft are directed substantially straight against one another.

13. The device as claimed in claim 1, wherein the resilient element is arranged on top of the rocker arm.

14. The device as claimed in claim 1, wherein the timing gear permits switching from an active to an inactive state during the return movement of the valve from an open position.

15. The device as claimed in claim 1, wherein the timing gear comprises a hydraulic piston cylinder which is mechanically connected to the valve and can be operated by a hydraulic valve.

* * * * *